United States Patent [19]

Zimmerman

[11] Patent Number: 4,592,097

[45] Date of Patent: Jun. 3, 1986

[54] SEAT LIFTER

[76] Inventor: Neil L. Zimmerman, 743 Williamson St., Madison, Wis. 53703

[21] Appl. No.: 577,568

[22] Filed: Feb. 6, 1984

[51] Int. Cl.[4] ..... A47K 13/10

[52] U.S. Cl. ..... 4/251

[58] Field of Search ..... 4/241, 251, 624, 250, 4/253; 220/263, 264, 262; 49/357

[56] References Cited

U.S. PATENT DOCUMENTS

| | | | |
|---|---|---|---|
| 158,677 | 1/1875 | Clark . | |
| 521,072 | 6/1894 | Andruss . | |
| 621,790 | 3/1899 | Burger et al. . | |
| 718,971 | 1/1903 | Becker . | |
| 789,962 | 5/1905 | Callahan, Jr. | 4/251 |
| 1,180,140 | 4/1916 | Godoy . | |
| 1,681,277 | 8/1928 | Booth . | |
| 2,088,050 | 7/1937 | Brown | 4/251 |
| 2,251,770 | 9/1941 | Warner | 4/251 |
| 2,305,147 | 12/1942 | Deal | 4/241 |
| 2,661,484 | 12/1953 | Jung | 4/251 |
| 2,836,080 | 5/1958 | Mullett | 4/624 |
| 2,877,469 | 3/1959 | Johnson | 4/241 |
| 3,493,974 | 2/1970 | Smith | 4/251 |
| 3,516,095 | 6/1970 | Clifton et al. | 4/251 |
| 4,055,864 | 11/1977 | Liu et al. . | |
| 4,195,372 | 4/1980 | Farina | 4/251 |
| 4,426,743 | 1/1984 | Seabrooke | 4/251 |

FOREIGN PATENT DOCUMENTS

| | | | |
|---|---|---|---|
| 342296 | 10/1921 | Fed. Rep. of Germany | 4/251 |
| 1068176 | 10/1959 | Fed. Rep. of Germany | 220/262 |
| 1090419 | 3/1959 | France | 220/262 |
| 72731 | 11/1959 | France | 4/251 |

*Primary Examiner*—Stephen Marcus
*Assistant Examiner*—Linda J. Sholl
*Attorney, Agent, or Firm*—Isaksen, Lathrop, Esch, Hart & Clark

[57] ABSTRACT

A toilet seat lifter for use with a conventional, floor-supported toilet. The toilet seat lifter has a foot pedal adapted to be hingedly attached to the toilet without permanent alteration thereof by means of at least one of the toilet attachment bolts that attaches the toilet to the floor. The foot pedal extends forwardly from its point of attachment to be depressable by the foot of a user. Lifting means are provided for lifting the seat of the toilet from its closed position toward its open position, the lifting means being adapted to be hingedly attached to the toilet by at least one of the seat attachment bolts by which the seat is attached to the toilet. A mechanical linkage is provided between the foot pedal and the lifting means whereby the lifting means lifts the seat toward the open position when the pedal is depressed by the foot of a user.

13 Claims, 5 Drawing Figures

SEAT LIFTER

TECHNICAL FIELD

The present invention relates to sanitary and convenient means for lifting the lid or seat of a toilet and, in particular, to such means that are adapted for operation by the foot of the user.

BACKGROUND OF ART

The user of a toilet having a toilet lid must of necessity open the lid before use. In addition, in a number of situations it is convenient or desirable that the seat of the toilet also be lifted before the toilet is used. Toilets can be unsanitary objects, especially when in public use, making it distasteful for a user to raise the lid or seat by hand. In addition, persons for whom bending over is impossible or at least painful as a consequence of back braces, injuries, and the like find it difficult to so maneuver as to be able to lift a toilet seat or lid. Thus, an action that is trivial and easy for most people may become difficult and the object of personal embarrassment.

Those skilled in the art are cognizant of a variety of aids for lifting toilet lids and seats. Examples of foot-operated lifters for toilet lids or seats are found in Burger and Williams, U.S. Pat. No. 621,790; Becker, U.S. Pat. No. 718,971; and Godoy, U.S. Pat. No. 1,180,140. All three require extensive installation procedures and represent permanent additions to or alterations of a toilet. As a consequence, such devices are not appropriate for use by a renter, a person with a temporary injury, or by others who need an effective foot-operated toilet seat lifter that does not require permanent alteration of a standard toilet or laborious or complicated installation. Liu et al., U.S. Pat. No. 4,055,864 shows a hand controlled electrical-mechanical system for opening and closing the lid and seat of a toilet, also providing for automatic flushing. The device is alternatively arranged for operation by foot and is also adapted to be used with an existing toilet.

Those skilled in the art are cognizant of various devices for keeping toilet seats or lids in a generally or partially open position. Examples include Clark, U.S. Pat. No. 158,677; Booth, U.S. Pat. No. 1,681,277; and Deal, U.S. Pat. No. 2,305,147. Clark and Booth show devices that are permanent parts of the toilet seats or lids shown. The device shown in Deal is adapted for use with a conventional toilet seat or lid. With these devices, it takes a positive action on the part of the user to place the seat or lid in a down or closed position. They are not designed to avoid the necessity of contacting the seat or lid by hand or for use by one who cannot lean forward.

BRIEF SUMMARY OF THE INVENTION

The present invention is summarized in that a toilet seat lifter is adapted to allow a user thereof to lift the toilet seat without manually touching it. The toilet seat lifter is adapted for use with a conventional, floor-supported toilet having a generally horizontal base flange resting on the floor, toilet attachment bolts engaged with the floor and extending upwardedly through the base flange with toilet attachment bolt nuts adapted to be tightened down on the base flange to secure the toilet to the floor, a bowl with a horizontal rim, and a seat hingedly attached to the rim of the bowl at a rearward location thereon by seat attachment bolts extending downwardly through the rim, the seat having a closed position wherein the seat extends substantially horizontally and an open position wherein the seat extends substantially vertically. The toilet seat lifter includes a foot pedal adapted to be hingedly attached to the toilet without permanent alteration thereof by means of at least one toilet attachment bolt and to extend forwardly therefrom to be depressable by the foot of a user. The toilet seat lifter further includes lifting means for lifting the seat from its closed position toward its open position, the lifting means being adapted to be hingedly attached to the toilet without permanent alteration thereof by at least one seat attachment bolt. A mechanical linkage is provided between the foot pedal and the lifting means whereby the lifting means lifts the seat toward the open position when the pedal is depressed by the foot of a user.

A primary object of the invention is to provide a device for lifting the lid or seat of a toilet in such a way that the user does not have to touch the seat or lid by hand.

A second object of the invention is to provide such a means for lifting a toilet lid or seat that may be foot-operated.

Another object of the invention provides means for conveniently opening the cover or lifting the seat of a conventional toilet readily usable by a person who cannot lean forward.

A further object of the invention is to provide such a device that may be easily and economically attached to a conventional toilet without damaging or altering the toilet.

Another object of the invention is to provide such a device that is convenient and practical for use over a relatively short period of time during convalescence from an injury or the like, with subsequent ready removal from a conventional toilet to leave an altered and undamaged toilet.

A further object of the invention is to provide such a device that is structurally simple and thus easy to manufacture, clean, and maintain.

Yet another object of the invention is to provide such a device by which a toilet seat may be raised when the toilet is to be used and then automatically returned to a lower position after use.

A further object of the invention is to provide in such a device means for lowering the toilet seat or lid in a gentle and controlled way.

Other objects, features, and advantages of the invention will be apparent from the following detailed description taken in conjunction with the accompanying drawings showing a preferred embodiment of a toilet seat lifter exemplifying the principles of the invention.

DETAILED DESCRIPTION OF THE PREFERRED EMBODIMENT

Figure 1:
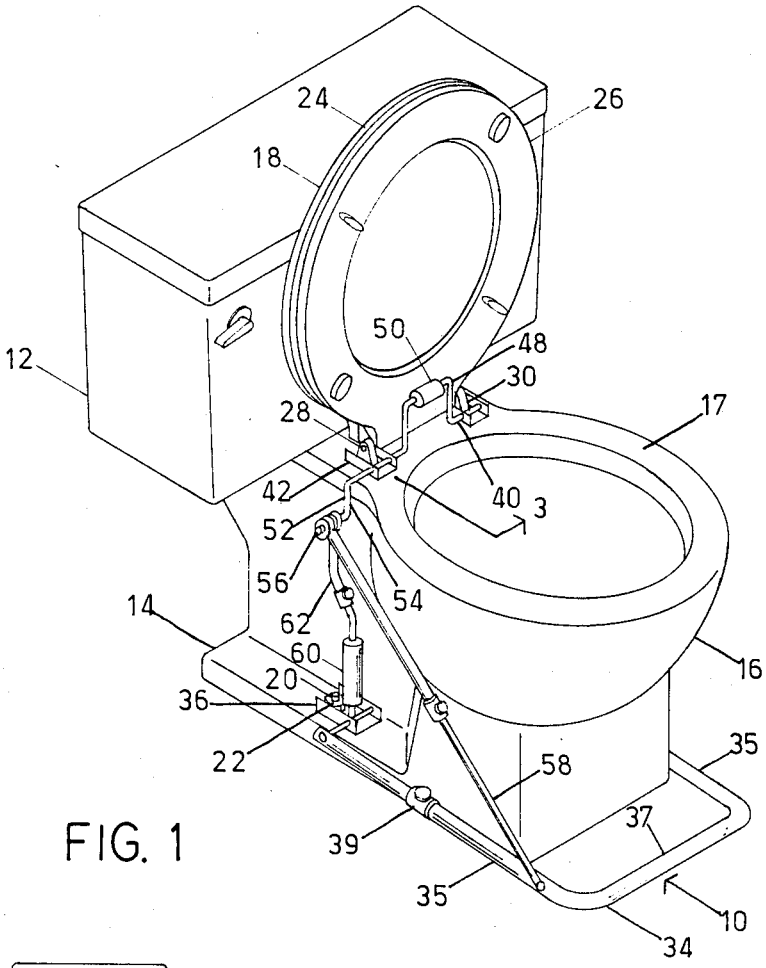
FIG. 1 is a perspective view of a toilet seat lifter constructed in accord with the present invention and installed on a conventional toilet, the view taken from a position generally in front of and to one side of the toilet.
Figure 2:
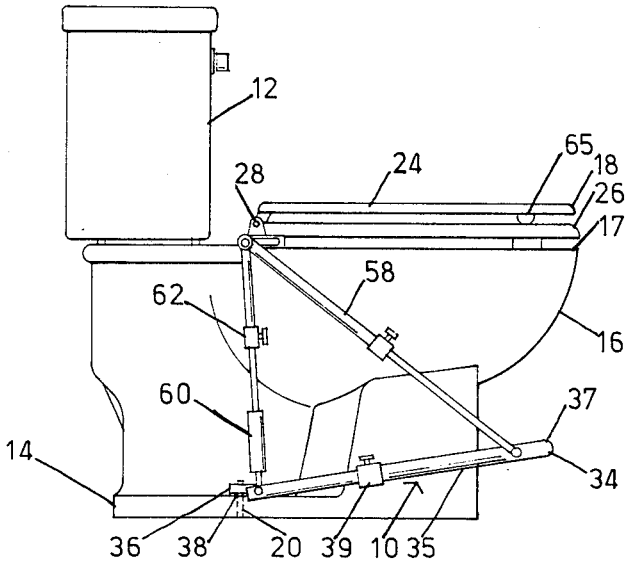
FIG. 2 is a side elevation view of the toilet seat lifter of FIG. 1.

Referring more particularly to the drawings, wherein like numbers refer to like parts, FIGS. 1 and 2 show a toilet seat lifter, generally indicated at 10, constructed in accord with the present invention. The toilet seat lifter 10 is adapted to be used with a conventional, floor-supported toilet 12 having a generally horizontal base flange 14, bowl 16, and lid and seat combination 18. For purposes of description, the bowl 16 shall be referred to as being to the front of the toilet 12, and all parts of the toilet and toilet seat lifter 10 shall be understood to have correspondingly front and rear parts. Conventionally, the base flange 14 of such toilets 12 is attached to the floor with toilet attachment bolts 20. Such toilet attachment bolts 20 are typically fastened in the floor on which the toilet 12 is resting and extend upwardly through holes (not shown) in the base flange 14. A toilet attachment nut 22 conventionally is threadedly received by each toilet attachment bolt 20 and is tightened down on the base flange 14 to secure the toilet 12. Typically at least two toilet attachment bolts 20 are so used, one on either side of the bowl 16 at a point generally toward the rear of the toilet 12. The spacing of such toilet attachment bolts 20 is standardized, allowing most conventional, floor supported toilets 12 to be interchangeably installed.

Figure 3:
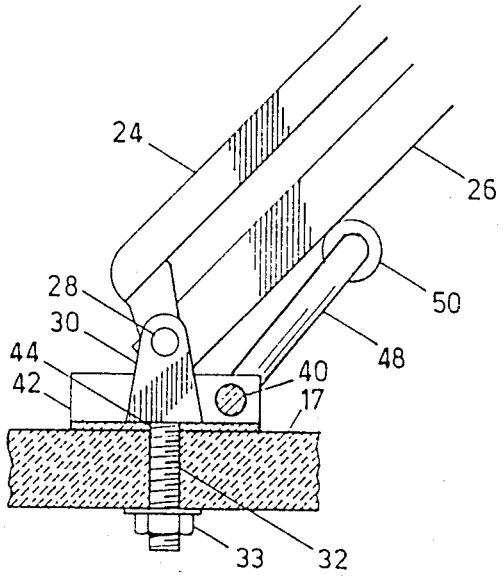
FIG. 3 is a cross section view of the support bar bracket and related structures of a portion of the toilet seat lifter and toilet of FIG. 1, taken at section lines 3—3.

The bowl 16 has a generally horizontal rim 17. Conventional lid and seat combinations 18 include a lid 24 that covers a seat 26. In some instances, the lid 24 is omitted. The lid 24 and seat 26 are hingedly joined to each other and attached to the rim 17 at the back of the bowl 16. The lid and seat 24, 26, individually and together, have a raised position, shown in FIG. 1, in which they extend generally vertically above their point of attachment to the bowl 16, and a closed position, shown in FIG. 2, in which they extend generally horizontally and forwardly over the rim 17 to cover the bowl. Each of the lid and seat 24, 26 has a top and an under side defined respectively as the upwardly and downwardly facing surfaces thereof when the lid and seat are in their closed position. The lid and seat 24, 26 turn on a hinge axle 28, which is typically held within bearing members 30 that in turn are fastened to the toilet 12 by seat attachment bolts 32, shown in FIG. 3. The seat attachment bolts 32 extend downwardly through the rim 17 of the bowl 16 to be secured by nuts 33. Although there is some variety in the exact arrangement of seat attachment bolts 32 in conventional toilets 12, their spacing and location is sufficiently standardized that universal lid and seat combination units 18 are commercially available that are expected to and in fact do fit most if not all conventional toilets 12.

The toilet seat lifter 10 of the invention takes advantage of the standard location and spacing of the toilet attachment bolts 20 and seat attachment bolts 32 in a conventional toilet 12. The toilet seat lifter 10 has a foot pedal 34 and at least one foot pedal support bracket 36. The foot pedal 34 is adapted to extend to and preferably around the front of the bowl 16 in the general vicinity of the base flange 14. Preferably the foot pedal 34 is substantially U-shaped, having two side portions 35 and a front portion 37. The closed end of the U-shape, which includes the front portion 37, extends across the front of the toilet 12, and the side arms of the U-shape, which include the side portions 35, extend rearwardly toward the toilet attachment bolts 20. Preferably the side portions 35 include telescoping sections with set screws, as is shown in FIGS. 1 and 2 at 39, or are otherwise of adjustable length to accommodate toilets 12 that extend forward of the toilet attachment bolts 20 to differing degrees. The foot pedal 34 is hingedly attached to the base flange 14. Preferably, the rearwardmost end of each side portion 35 of the U-shaped foot pedal 34 is attached in hinged relation to a foot pedal support bracket 36 in such a way that, with the foot pedal support brackets held stationary, the foot pedal can be rotated, with the front portion 37 moving up and down.

The foot pedal support brackets 36 are adapted to be held in place relative to the toilet 12 by pressure exerted by the toilet attachment nuts 22. For example, the attachment nuts 22 may be loosened, a part of a foot pedal support bracket 36 inserted under the toilet 12, and the attachment nuts retightened to clamp the inserted part of the bracket between the toilet and the floor. However, in the preferred embodiment, the foot pedal support brackets 36 each have a hole 38 (shown in phantom in FIG. 2) adapted to receive a toilet attachment bolt 20. The toilet attachment nut 22 may then be turned down upon the toilet attachment bolt 20 to secure the foot pedal support bracket 36 to the base flange 14 of the toilet 12. Because the size and placement of the toilet attachment bolts 20 is standardized, a single size of foot pedal 34 is thus adapted to be attached to any of a wide variety of conventional toilets 12.

The toilet seat lifter 10 of the invention further includes a roller support bar 40 and at least one support bar bracket 42. The roller support bar 40 is rotatively fastened to at least one and preferably two support bar brackets 42. Each support bar bracket 42 has a hole 44 adapted to receive a seat attachment bolt 32, the support bar brackets 42 being thus adapted to be attached to the toilet 12 between the rim 17 and the bearing members 30 of the lid and seat combination 18 by means of the seat attachment bolts 32. The roller support bar 40 is so attached to the support bar brackets 42 that, when they are attached to the toilet 12 in the manner disclosed above, the roller support bar 40 is adapted to rotate about an axis parallel to that of the hinge axle 28, said axis being preferably slightly forward of the hinge axle. Because of the standardization of the location and distance between seat attachment bolts 32 adapted for use with conventional toilets 12, a single design for a roller support bar 40 and accompanying support bar brackets 42 may be used with a wide variety of conventional toilets and be held in substantially the same relation to the lid 24 and seat 26 of conventional lid and seat combination units 18 installed thereon.

The roller support bar 40 extends at least between the support bar brackets 42 and sufficiently beyond a selected one of the support bar brackets that, when the foot pedal support brackets 36 and the roller support bar both are attached to the toilet 12 by the means disclosed, at least one end of the support bar axle extends laterally with respect to the toilet at least as far as one of the foot pedal support brackets. A roller arm 48 is attached to the roller support bar 40 at a point between the support bar brackets 42 and extends laterally to the longitudinal axis of the support bar. Preferably the roller support bar is bent at an angle to the longitudinal axis of the roller support bar 40 to form a first lateral member 45, is bent again to form a roller bearing member 46 with an orientation parallel to said longitudinal axis, is then bent again to form a second lateral member 47 generally corresponding to the first lateral member and extending back to the longitudinal axis of the roller support bar, and finally is bent yet again to return to said longitudinal axis. The first lateral member, roller bearing member, and second lateral member 45, 46, 47 taken together constitute a preferred embodiment of the roller arm 48. The roller arm 48 is so oriented that, when the support bar brackets 42 are mounted on the toilet 12 in the manner disclosed above, the roller arm extends generally parallel to and beneath the under side of the toilet seat 26. A roller 50 is attached to the roller bearing member 46 in rotating relation. When in place on the toilet 12, the roller 50 is adapted to engage the under side of the seat 26 in rolling relation. Preferably the roller 50 is slightly resilient or is otherwise adapted not to mar the under side of the seat 26.

A roller support bar lever 52 extends from the roller support bar 40 in a direction generally opposite to the direction of extension of the roller arm 48. The roller support bar lever 52 preferably is located substantially over a foot pedal support bracket 36. When the roller support bar 40 is mounted on the toilet 12 in the manner disclosed above, the roller support bar lever 52 extends rearwardly when the roller arm 48 extends forwardly and horizontally. The lever 52 has a first portion 54 so extending from the roller support bar 40 and a second portion 56 extending parallel to the longitudinal axis to the roller support bar at a point remote therefrom.

A first linkage 58 is pivotably attached to both the second portion 56 of the roller support bar lever 52 and to the side 35 of the foot pedal 34 located generally under said second portion. The first linkage 58 is attached to the side 35 of the foot pedal 34 at a point remote from the foot pedal support bracket 36 associated therewith. The first linkage 58 is adjustable in length. Preferably, the first linkage 58 is a telescoping rod of adjustable length that can be locked at selected maximum lengths. However, a cable or comparable flexible or inflexible adjustable member adapted to be adjusted to fixed, maximum lengths would also be satisfactory and within the scope and spirit of the invention.

The length of the first linkage 58 is so adjusted that, with the seat 26 in its closed position and the roller 50 immediately adjacent to the under side of the seat, the front portion 37 of the foot pedal 34 is held a selected distance above the level of the floor supporting the toilet 12. The length of the first linkage 58 is selected to be such that when the front portion 37 of the foot pedal 34 is depressed to the floor, the roller support bar lever 52 is drawn downwardly and forwardly by the first linkage sufficiently that the roller 50, being fastened to the roller arm 48 that moves with the lever 52, pushes against the under side of the seat 26 to elevate it a selected distance toward its raised position.

It will be apparent that, so long as the center of gravity of the seat 26 is forward of the hinge axle 28, the weight of the seat will tend to lower the seat to its closed position, pushing the roller 50 before it and thereby causing the lever 52 to move backwardly and upwardly. The user of the toilet seat lifter 10 can control the speed of descent of the seat 26 simply by releasing the foot pedal 34 in a controlled manner. Alternatively, a means for damping the backward and upward movement of the lever 52 may be provided to slow the descent of the seat. The preferred embodiment of such damping means is a pneumatic cylinder 60 attached in pivoting relation both to the second portion 56 of the lever 52 and to the foot pedal support bracket 36 located generally thereunder. The pneumatic cylinder 60 is adapted to allow the second portion 56 of the lever 52 to freely be lowered but to retard its upward movement. Preferably the pneumatic cylinder 60 is attached to the second portion 56 of the lever 52 by a second linkage 62 adapted to be adjustable in length. By this means, variations in the dimensions of the toilet 12, such as in the distance between the base 14 and bowl rim 17, may be accommodated.

In use, the toilet seat lifter 10 is installed on a toilet 12 by fastening the foot pedal support brackets 36 to the base 14 by means of the toilet attachment bolts 20, as is disclosed above, and by attaching the support bar brackets 42 to the bowl rim 17 by means of the seat attachment bolts 32, as is disclosed above. As the front portion 37 of the foot pedal 34 is depressed, the lever 52 turns, forcing the roller 50 against the under side of the seat 26 to lift it toward its raised position. The length of the first linkage 58 may be adjusted so as to provide that the seat 26 is raised to the desired extent when the front portion 37 of the foot pedal 34 is depressed to the level of the floor on which the toilet 12 is resting. The second linkage 62 is similarly adjusted in length to accommodate the dimensions of the toilet, as is referred to above. A user of the toilet may then raise the seat 26 and the lid 24, if any, that rests on top of it by depressing the foot pedal 34 with his foot. When the user's foot is removed from the pedal 34, the weight of the seat 26 and any lid 24 causes them to return to the closed position in a movement that may be damped by the pneumatic cylinder 60.

It is possible for a conventional lid 24 and seat 26 to be moved to a raised position and then to be moved further in the same direction to lean slightly away from the bowl 16 with their centers of gravity rearward of the hinge axle 28. When so moved, conventional lid and seat combination units 18, as well as conventional, separate seats 26, commonly have some stopping mechanism that limits the ability of the lid 24 and seat to move excessively rearwardly beyond the generally vertical raised position, holding the lid and seat in a generally upright, hyperextended position. In such an event, the weight of the lid and seat tend to hold them in the hyperextended position rather than to urge them toward the closed position, and it is necessary to manually move them forward to close them. To avoid this need, and in those instances in which fastening something to the lid 24 or seat 26 is acceptable, means are provided for urging the seat forwardly until its center of gravity is forward of the hinge axle 28. For example, a resilient pad 65 may be mounted on the underside of the lid 24 and be adapted to contact and exert force against the top side of the seat 26 when the lid and seat are both in the hyperextended position. The shape, resilience, and size of the pad are selected to be such that the seat 26 is urged forwardly from the hyperextended position to the point that its center of gravity is forward of the hinge axle 28 so that it will move toward the closed position as a consequence of its own weight. The resilience of the pad is further selected so as to not be uncomfortable to the back of a person seated on the seat 26 in its closed position and leaning back toward the under side of the lid 24.

Figure 4:
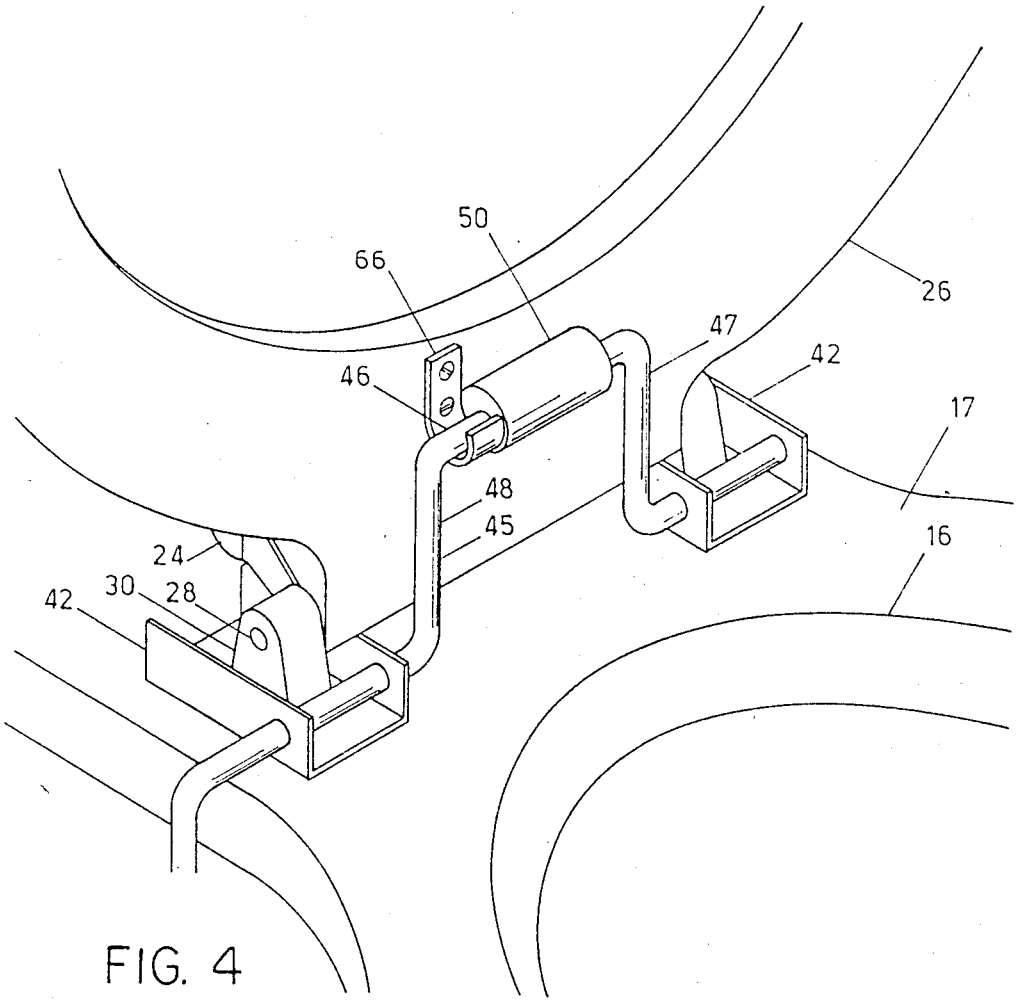
FIG. 4 is a perspective view of a support bar bracket and related structures.

Alternative means for urging the seat 26 forward include a flexible spring strap 64, shown in FIG. 4. The flexible spring strap 64 may be made of any suitable material exhibiting a desirable degree of flexibility and resilience. The flexible spring strap 64 is attached to the under side of the seat 26 at a convenient point where it will not interfere with the operation of the roller 50. The flexible spring strap 64 extends rearwardly of the hinge axle 28 when the seat 26 is in its closed position and has a length selected to be sufficient to engage the rim 17 at some point as the seat moves from its closed to its raised position, the flexible spring strap flexing increasingly as the seat moves rearwardly in response to pressure exerted against the under side of the seat by the roller 50. The resilience of the flexible spring strap 64 causes it to tend to straighten and, as a result, to urge the seat 26 forwardly. The length and resilience of the flexible spring strap 64 is selected to be sufficient to cause the seat 26 to be pulled forward of the point at which its center of gravity is over the hinge axle 28.

Figure 5:
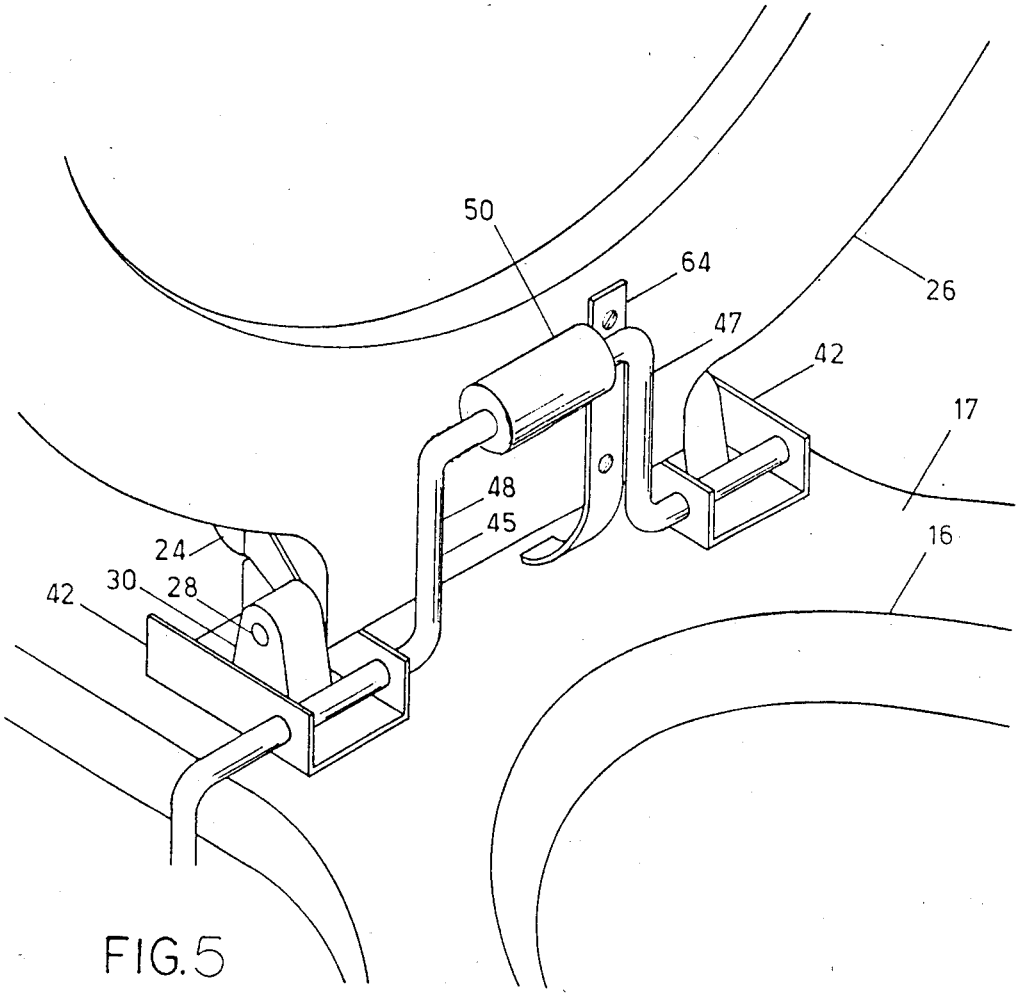
FIG. 5 is a perspective view of a support bar bracket comparable to that of FIG. 4, showing alternative means for urging the seat forward.

A third alternative means for urging the seat 26 forwardly includes a hook 66 (shown in FIG. 5) adapted to be fastened to the under side of the seat and opening forwardly when the seat is in its closed position. As the seat 26 is raised by means of pressure from the roller 50, the roller moves across the under side of the seat and generally toward the location of the hinge axle 28. The hook 66 is adapted to engage the roller bearing member 46 or other selected part of the roller arm 48 or roller 50 as the seat 26 is raised, limiting the rearward movement of the seat. If the hook 66 is so located that the rearward movement of the seat 26 is stopped before its center of gravity passes to the rear of the hinge axle 28, the seat will never reach a hyperextended position. Alternatively, the hook 66 may be so located that a hyperextended position of the seat 26 is possible but with the roller bearing member 46 then engaged in the hook. In that case, the user may draw the seat forwardly by pulling the foot pedal 34 upwardly with his toe, whereupon the roller bearing member 46 will pull forwardly on the hook. Alternatively, other means may be provided for urging the roller arm 48 forwardly. For example, if a pneumatic cylinder 60 is used, as described above, a conventional compression spring (not shown) can be associated therewith tending to force the roller support bar lever 52 backwardly and upwardly. Various other means for so urging the roller support bar 40 will be obvious to one skilled in the art and are included within the scope and spirit of the invention.

Preferably the hook 66 is located sufficiently rearwardly on the under side of the seat 26 that no part of the roller arm 48 or roller 50 is engaged therein when the seat is in its closed position. The seat 26 may then be raised freely by hand without using the toilet seat lifter 10 or engaging the hook 66 if it is desired to move the seat to a hyperextended position for purpose of cleaning or the like.

The rigid parts of the toilet seat lifter may be made by conventional means of any suitable strong and rigid material, including metal and selected plastics. It is understood that the present invention is not limited to the particular construction and arrangement of parts illustrated and disclosed. Instead it embraces all such modified forms thereof as come within the scope of the following claims.

What is claimed is:

1. A toilet seat lifter for use with a conventional floor-supported toilet having a generally horizontal base flange resting on the floor, toilet attachment bolts engaged with the floor and extending upwardly through the base flange with toilet attachment bolts nuts threadedly engaged thereon and adapted to be tightened down on the base flange to secure the toilet to the floor, a bowl with a generally horizontal rim, seat attachment bolts, and a seat hingedly attached to the rim of the bowl at a rearward location thereon by the seat attachment bolts, which extend downwardly through the rim, the seat having a closed position wherein the seat extends substantially horizontally and an open position wherein the seat extends substantially vertically, the seat having an underside including surfaces presenting downwardly when the seat is in its closed position, the toilet seat lifter comprising:

(a) a foot pedal adapted to be hingedly attached to the toilet and including at least two foot pedal support brackets, each foot pedal support bracket having a hole extending therethrough that is adapted to receive a toilet attachment bolt, whereby the foot pedal support bracket may be attached to the toilet with one foot pedal support bracket on either side of the toilet, the foot pedal having two substantially straight, forward extending side portions, one of which is hingedly attached to each of the foot pedal support brackets, and a front portion connecting the two side portions, the front portion connected to the two side portions, the front portion being adapted to pass around the front of the toilet;

(b) lifting means for lifting the seat from its closed position toward its open position, the lifting means being adapted to be hingedly attached to the toilet by at least one seat attachment bolt without permanent alteration of the toilet, the lifting means including at least one support bar bracket adapted to be mounted between the bowl rim and a bearing member by a seat attachment bolt, the bearing member supporting a hinge axle for rotation of the seat, a support bar rotatably mounted to the support bar bracket, the support bar being adapted to rotate about an axis parallel to that of the hinge axle, the axis being located under the seat and forward of the hinge axle the support bar having a member extending parallel to the axis of rotation of the support bar under the seat at a position forwardly of the hinge axle, the support bar also including a lever portion extending away from the axis of rotation of the support bar at a position outwardly of the support bar bracket so that the lever may freely rotate without interference from the rim of the bowl; and (c) a mechanical linkage connected between the foot pedal and the lever of the lifting means such that the lifting means lifts the seat toward the open position when the pedal is depressed by the foot of a user.

2. The toilet seat lifter of claim 1 wherein the side portions of the foot pedal are adapted to be adjusted in length to accommodate toilets that extend forward of the toilet attachment bolts to differing degrees.

3. The toilet seat lifter of claim 2 wherein the side portions include telescoping sections.

4. A toilet seat lifter for use with a conventional, floor-supported toilet having a generally horizontal base flange resting on the floor, toilet attachment bolts engaged with the floor and extending upwardly through the base flange with toilet attachment bolts nuts threadedly engaged thereon and adapted to be tightened down on the base flange to secure the toilet to the floor, a bowl with a generally horizontal rim, seat attachment bolts, and a seat hingedly attached to the rim of the bowl at a rearward location thereon by the seat attachment bolts, which extend downwardly through the rim, the seat having a closed position wherein the seat extends substantially horizontally and an open position wherein the seat extends substantially vertically, the seat having an under side including surfaces presenting downwardly when the seat is in its closed position, the toilet seat lifter comprising:

(a) a foot pedal adapted to be hingedly attached to the toilet at a selected point of attachment, without permanent alteration of the toilet, by means of pressure exerted by at least one toilet attachment bolt nut and to extend forwardly from the point of attachment to be depressable by the foot of a user;

(b) lifting means for lifting the seat from its closed position including at least one support bar bracket, each support bar bracket having a hole passing therethrough adapted to receive a seat attachment bolt, the support bar bracket being adapted to be held into place on the rim of the bowl thereby, a support bar rotatably mounted to the support bar bracket to rotate an axis parallel to a hinge axle which attaches the seat to the rim, the support bar including a lateral member extending away from the axis of rotation inwardly of the support bar bracket, a roller bearing member extending therefrom parallel to the axis of rotation, and a support bar lever extending away from the axis of rotation outwardly of the support bar bracket so that the lever may freely rotate without interference from the rim of the bowl; and (c) a mechanical linkage connected between the foot pedal and the support bar lever of the lifting means whereby the lifting means lifts the seat toward the open position when the pedal is depressed by the foot of a user, the mechanical linkage being connected to the lever to turn the same downwardly to rotate the support bar and drive the roller bearing member upwardly against the under side of the seat when the pedal is depressed.

5. The toilet seat lifter of claim 4 further including a roller mounted on the roller bearing member and wherein the mechanical linkage is pivotably attached to the support bar lever at a point remote from the axis of rotation of the support bar and to the foot pedal at a point remote from the toilet attachment bolt and includes an adjustable member adapted to be adjusted to a fixed maximum length, whereby the roller support bar lever may be drawn downwardly and forwardly when the foot pedal is depressed by the foot of a user, causing the support bar to turn and the roller bearing member and roller attached thereto to force the seat upwardly toward its raised position.

6. The toilet seat lifter of claim 5 wherein the adjustable member is a telescoping rod.

7. The toilet seat lifter of claim 5 including at least two foot pedal support brackets, each foot pedal support bracket having a hole extending therethrough that is adapted to receive a toilet attachment bolt, the foot pedal support bracket being adapted to be attached thereby to the toilet, with one foot pedal support bracket on either side of the toilet, and wherein the foot pedal has two side portions, one of which is hingedly attached to each of the foot pedal support brackets, and a front portion connecting the two generally straight and forwardly extending side portions, the front portion being adapted to pass around the front of the toilet.

8. The toilet seat lifter of claim 7 adapted for use with a toilet in which the seat is fastened to a hinge axle about which it rotates when it moves between its open and closed positions and in which the seat may be moved to a hyperextended position in which the center of gravity of the seat is rearward of the hinge axle, the toilet seat lifter including urging means for urging the seat forwardly when it is in its open position until its center of gravity is forward of the hinge axis to so position the lid that its own weight will tend to bias it toward its closed position.

9. The toilet seat lifter of claim 5 including means for damping the backward and upward movement of the roller support bar lever, whereupon the descent of the seat may be controlled.

10. The toilet seat lifter of claim 9 wherein the means for damping is a pneumatic cylinder attached to the roller support bar lever and to a foot pedal support bracket.

11. The toilet seat lifter of claim 10 wherein the means for damping includes a second linkage attaching the pneumatic cylinder to the roller support bar lever, said second linkage adapted to be adjustable in length to accommodate the particular dimensions of the toilet.

12. A toilet seat lifter for use with a conventional, floor-supported toilet having a generally horizontal base flange resting on the floor, toilet attachment bolts engaged with the floor and extending upwardly through the base flange with toilet attachment bolt nuts threadedly engaged thereon and adapted to be tightened down on the base flange to secure the toilet to the floor, a bowl with a generally horizontal rim, seat attachment bolts, and a seat hingedly attached to the rim of the bowl at a rearward location thereon by the seat attachment bolts, which extend downwardly through the rim, the seat having a closed position wherein the seat extends substantially horizontally and an open position wherein the seat extends substantially vertically, the seat being fastened to a hinge axle about which it rotates when it moves between its open and closed positions, the seat being movable to a hyperextended position in which the center of gravity of the seat is rearward of the hinge axle, the seat also having an underside including surfaces presenting downwardly when the seat is in its closed position, the toilet further including a lid joined to the seat in hinged relation and adapted to extend over and cover the seat when the seat is in its closed position, the lid having an underside presenting toward the seat, the toilet seat lifter comprising:

(a) a foot pedal adapted to be hingedly attached to the toilet at a selected point of attachment adjacent to the base flange and to extend forwardly from the point of attachment to be depressable by the foot of the user;

(b) lifting means for lifting the seat from its closed position toward its open position, the lifting means being adapted to be hingedly attached to the toilet substantially at the location of at least one seat attachment bolt;

(c) means for linking the foot pedal and the lifting means to cause the lifting means to lift the seat toward the open position when the pedal is depressed by the foot of the user; and (d) urging means for urging the seat forwardly when it is in its open position until its center of gravity is forward of the hinge axle to so position the seat that its own weight will tend to bias it toward the closed position, the urging means including a flexible spring strap having a selected degree of flexibility and resilience, the flexible spring strap being attached to the underside of the seat and extending rearwardly of the hinge axle when the seat is in its closed position, the flexible spring strap having a length selected to be sufficient to engage the rim and increasingly flex as the seat is moved from its closed to its raised position to urge the seat forwardly as a consequence of the tendency of the flexible spring strap to straighten, the length and resilience of the flexible spring strap being selectably sufficient to cause the seat to move forward until its center of gravity is forward of the hinge axle.

13. A toilet seat lifter for use with a conventional, floor-supported toilet having a generally horizontal base flange resting on the floor, toilet attachment bolts engaged with the floor and extending upwardly through the base flange with toilet attachment bolt nuts threadedly engaged thereon and adapted to be tightened down on the base flange to secure the toilet to the floor, a bowl with a generally horizontal rim, seat attachment bolts, and a seat hingedly attached to the rim of the bowl at a rearward location thereon by the seat attachment bolts, which extend downwardly through the rim, the seat having a closed position wherein the seat extends substantially horizontally and an open position wherein the seat extends substantially vertically, the seat being fastened to a hinge axle about which it rotates when it moves between its open and closed positions, the seat being movable to a hyperextended position in which the center of gravity of the seat is rearward of the hinge axle, the seat also having an underside including surfaces presenting downwardly when the seat is in its closed position, the toilet further including a lid joined to the seat in hinged relation and adapted to extend over and cover the seat when the seat is in its closed position, the lid having an underside presenting toward the seat, the toilet seat lifter comprising:

(a) a foot pedal adapted to be hingedly attached to the toilet at a selected point of attachment adjacent to the base flange and to extend forwardly from the point of attachment to be depressable by the foot of the user;

(b) lifting means for lifting the seat from its closed position toward its open position, the lifting means being adapted to be hingedly attached to the toilet substantially at the location of at least one seat attachment bolt, the lifting means including a support bar axle rotatably mounted on the rim of the bowl, a roller arm rigidly attached to the support bar axle and extending forwardly under the seat when the seat is in its closed position, and a roller rotatably mounted on the roller arm and adapted to contact the underside of the seat;

(c) means for linking the foot pedal and the lifting means to cause the lifting means to lift the seat toward the open position when the pedal is depressed by the foot of the user; and (d) urging the means for urging the seat forwardly when it is in its open position until its center of qravity is forward of the hinge axle to so position the seat that its own weight will tend to bias it toward the closed position, the means for linking the foot pedal being adapted to turn the support bar axle when the pedal is depressed to move the roller upwardly against the underside of the seat, the urging means including a hook adapted to be fastened to the underside of the seat ad opening forwardly when the seat is in its closed position, the hook being adapted to engage a selected part of one of the roller arm and roller as the seat is raised to limit the rearward movement of the seat.

* * * * *